United States Patent [19]

Sivolap et al.

[11] 4,149,832

[45] Apr. 17, 1979

[54] TURBOCOMPRESSOR

[76] Inventors: Georgy P. Sivolap, ulitsa Kalinina, 106, kv. 21; Vyacheslav A. Potanin, ulitsa Suvorova, 184, kv. 111; Nikolai A. Belinsky, ulitsa Suvorova, 125, kv. 57; Evgeny A. Mezhgorin, ulitsa Kalinina, 110a, kv. 74, all of Penza, U.S.S.R.

[21] Appl. No.: 823,865

[22] Filed: Aug. 11, 1977

[51] Int. Cl.[2] ..... F04B 17/00

[52] U.S. Cl. ..... 417/409; 60/605; 415/178; 417/373

[58] Field of Search ..... 417/407, 408, 409, 372, 417/373; 415/178, 219 R, 219 B, 219 C; 60/605

[56] References Cited

U.S. PATENT DOCUMENTS 2,682,365 6/1954 Pielstick ..... 415/178

FOREIGN PATENT DOCUMENTS 2407855 10/1974 Fed. Rep. of Germany ..... 417/409
2416255 10/1974 Fed. Rep. of Germany ..... 417/409
1022177 3/1953 France ..... 417/409
661228 11/1951 United Kingdom ..... 417/372

*Primary Examiner*—C. J. Husar
*Attorney, Agent, or Firm*—Haseltine, Lake & Waters

[57] ABSTRACT

A turbocompressor which comprises a compressor housing receiving therein the rotor of the compressor, a gas intake housing adapted to direct a hot gas to the rotor of the turbine. The rotor of the turbine is mounted on the same shaft with the rotor of the compressor. The turbocompressor further comprises a housing cooled by a fluid, for example water, for escape of exhaust gases from the turbine, comprising a load-carrying framework formed by two spaced flanges and rigid longitudinal thin-walled shaped steel elements spaced from one another and interconnecting the flanges. The spaces between the elements are filled with thin steel panels defining jointly with the shaped elements the external wall of the housing. The internal wall of the cooled housing is made in the form of a plain thin-walled trough-shaped steel sheet secured to the flanges and arranged so that a space for circulation of the cooling fluid is afforded between the external and internal walls of the housing.

4 Claims, 3 Drawing Figures

TURBOCOMPRESSOR

FIELD OF THE INVENTION

The present invention relates to turbine-type machines, and, more particularly, to turbocompressors.

The invention can be utilized to utmost effectiveness in turbocompressors used as superchargers in compression-ignited internal combustion engines and gas engines, as it is commonly known that supercharging, i.e. filling the working cylinders of internal combustion engines with air under gauge pressure is one of the most effective ways of stepping up the power output of an engine. In a cylinder of an engine of a given displacement volume, the use of supercharging enables accommodation of a greater weight charge of air and, hence, combustion of a greater amount of the fuel and thereby production of greater power.

PRIOR ART

Turbocompressors for supercharging internal combustion engines are commonly known. A typical turbocompressor of this type has a compressor housing accommodating the rotor of the compressor therein, a gas intake housing for directing a hot gas to the rotor of the turbine, the rotor being mounted on the same shaft with the rotor of the compressor. The turbocompressor further includes an outlet housing cooled by a fluid, for example, water, for escape of spent gases from the turbine.

In the hitherto known turbocompressor of the above-described type the housing for escape of spent gases is usually a casting made of either ferrous metals (e.g. cast iron), or else of aluminum alloys, the housing having double walls affording therebetween a space for circulation of the cooling fluid. Such housings cast of ferrous metals have a relatively great weight caused by the thickness of their walls, which is determined by the positive limits of casting technology. Housings cast of aluminum alloys, on the other hand, are not sufficiently heat-resistant, since at temperatures above 400° C. recrystallization of the aluminum alloy takes place, which affects the strength of the structure.

Furthermore, the use of cast housings, be it ferrous metals or aluminum alloys, involves the hazard of such specific casting flaws as cavities, cracks, uncast zones, narrowed portions, etc. Moreover, cast housings require considerable amounts of metals, on account of significant allowances for subsequent machining and of the relatively great wall thickness.

There are also known turbocompressors wherein the cooled housing for withdrawal of spent gases from the turbine is a structure welded from steel sheets. The required strength and rigidity of such housing are provided for by the thickness of plain steel sheets making up the external and internal shells of the housing. The housing is made of steel sheets having the same thickness as the walls of the cast housing, the shape being also similar to that of the cast housing. This cooled gas escape housing has a considerable weight approaching that of a housing cast of ferrous metals, on account of the inefficient use of the inherent properties of the material and the adopted method of manufacture, i.e. welding.

SUMMARY OF THE INVENTION

It is, therefore, an object of the present invention to reduce the weight of the cooled housing for escape of spent gases from the turbine of a turbocompressor, while retaining its thermal resistance, strength and rigidity.

It is another object of the present invention to increase factor of the utilization of the material.

With these and other objects in view, the essence of the present invention resides in a turbocompressor including a compressor housing accommodating therein the rotor of the compressor, a gas intake housing for directing a hot gas to the rotor of the turbine, the rotor of the turbine being mounted on the same shaft with the rotor of the compressor, and a cooled housing for escape of spent gases from the turbine, in which turbocompressor, in accordance with the present invention, the cooled housing is made in the form of a framework defined by two spaced flanges and longitudinal rigid shaped thin-wall steel elements interconnecting the flanges and spaced from one another, the spaces between these elements being filled with thin steel panels defining jointly with the shaped elements the external wall of the housing, the internal wall of the housing being in the form of a plain thin-wall trough-shaped steel sheet secured to the flanges and arranged so that a space is defined intermediate the external and internal walls of the housing for circulation of a cooling fluid therethrough.

The strength and rigidity of the housing are provided for at the expense of being a load-carrying framework made up of the two flanges and the shaped rigid elements interconnecting the flanges.

Owing to the herein disclosed structure, the weight of the cooled housing for escape of spent gases from the turbine has been reduced 1.8 times in comparison with a housing cast of ferrous metals, the total weight of the turbocompressor incorporating this housing being reduced accordingly. Furthermore, the cooled housing for escape of spent gases from the turbine, constructed in accordance with the present invention, features an increased repairability, i.e. it is well suited for detecting therein and eliminating various flaws and damaged areas, both in the manufacture and throughout its service life, the repairs being effected by simple welding techniques.

If compared with cast housings, the housing embodying the invention offers a higher material utilization factor, the structure of the housing being based as it is completely on the use of cold-shaped rolled sections for the rigid shaped elements, and thin panels spanning the spaces between the shaped elements, the internal wall and the flanges being made by pressing techniques from strip steel stock, with minimal machining allowances.

It is expedient that the plain thin-wall steel sheet defining the internal wall of the housing should be connected to the panels defining the external walls of the housing with connecting members, in at least two areas symmetrical with respect to a vertical plane.

Cooled housings for escape of spent gases from turbines, constructed in accordance with the present invention, can be incorporated in turbocompressors of various sizes, their own sizes varying, depending on the actual size and type of the turbocompressor. Turbocompressors of larger types, intended for use with high-power diesel engines, up to 7,000 hp, have a cooled housing wherein the spacing of the shaped elements can be such that the pressure of the cooling fluid circulating through the space between the external and internal walls may cause deformation of the thin sheet defining the internal wall of the housing and of the panels spanning the spaces between the shaped elements. To preclude such deformation, it is expedient that the internal wall of a larger housing should be connected in at least two areas with the external wall defined by the panels spanning the spaces between the shaped elements.

It is further expedient that the longitudinal rigid shaped steel elements should be substantially trough-shaped and should have their concave sides facing the internal wall of the housing.

A turbocompressor constructed in accordance with the present invention and intended for supercharging internal combustion engines enables increasing the power output of the engine 2.5 to 3 times, with the pressure increase rate in the compressor being as high as 4.0, and the capacity from 2.7 to 10 kg/sec, depending on the type and size.

Turbocompressors embodying the present invention can be associated with engines having a mean effective pressure up to 25 kg/cm$^2$ and a power rating up to 7,000 hp, the efficiency factor of the turbocompressor being about 60%. The mass of a turbocompressor of the herein described type is 270 to 400 kg, depending on the size.

BRIEF DESCRIPTION OF THE DRAWINGS

Other objects and advantages of the present invention will be made apparent in the following detailed description of an embodiment thereof, with reference being had to the accompanying drawings, wherein.

DETAILED DESCRIPTION

Figure 1:
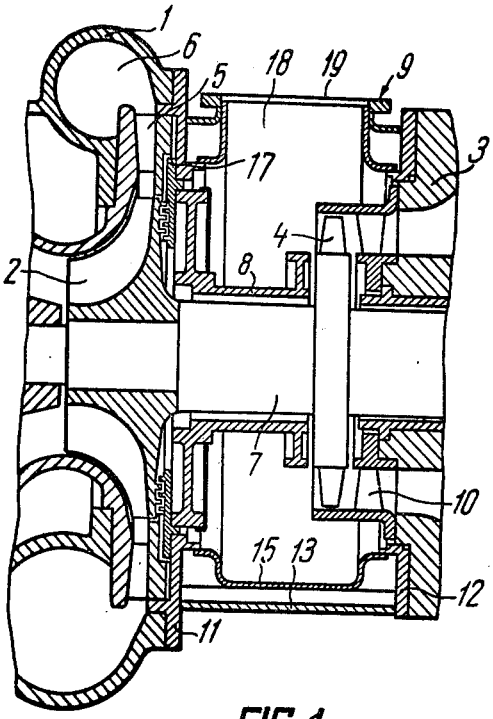
FIG. 1 is a schematic longitudinal sectional view of a turbocompressor embodying the invention.

In the drawings, the turbocompressor includes a compressor housing 1 (FIG. 1) accommodating therein the rotor 2 of the compressor, a gas intake housing 3 adapted to direct a hot gas to the rotor 4 of the turbine. Arranged behind or downstream of the rotor 2 of the compressor in the direction of the air flow is a diffuser 5 through which the air is directed into the scroll 6 of the compressor housing, to be directed therefrom into the cylinders of the associated engine (not shown).

Figure 2:
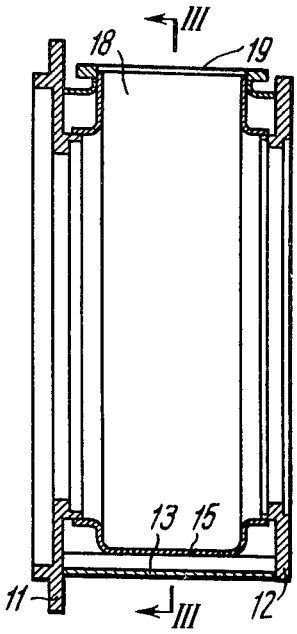
FIG. 2 is a schematic longitudinal sectional view of the cooled housing for escape of spent gases from the turbine.
Figure 3:
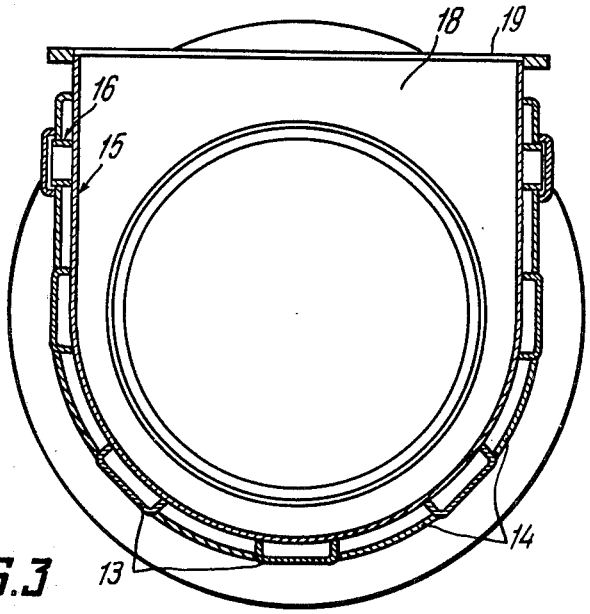
FIG. 3 is a sectional view taken on line III—III in FIG. 2.

The rotor 4 of the turbine is mounted on the same shaft 7 with the rotor 2 of the compressor. The shaft 7 is protected from the action of hot exhaust gases by a heat-insulation jacket 8. Furthermore, the turbocompressor comprises a cooled housing 9 for escape of spent gases from the turbine. In front or upstream of the rotor 4 of the turbine in the direction of the gas flow a nozzle ring 10 is mounted in the bore of the gas intake housing 3, adapted to direct the flow of the hot gas onto the turbine rotor 4. The cooled housing 9 for escape of spent gases from the turbine is made in the form of a load-carrying framework defined by two flanges 11 and 12 (FIG. 2) spaced from each other and by shaped longitudinal rigid thin-wall steel elements 13 spaced from one another and interconnecting the flanges 11 and 12. The spaces between the elements 13 are filled with panels 14 (FIG. 3) defining jointly with the longitudinal elements 13 the external wall of the housing 9. The internal wall of the housing 9 is in the form of a thin plain trough-shaped steel sheet 15 secured to the flanges 11 and 12 and arranged so that a space is defined between the internal and external walls of the housing 9 for circulation of a cooling fluid therethrough, the internal wall being connected to the panels 14 defining the external wall of the housing 9 with at least two connecting members 16 in at least two areas. Due to the incorporation of the connecting members 16, deformation of the internal wall 15 of the housing 9 is precluded by the pressure of the cooling fluid circulated through the space defined between the external and internal walls of the housing 9.

A cylindrical counterbore of the housing 9 (FIG. 1) on the side of the flange 11 houses a labyrinth seal 17 preventing air leakage from the rotor 2 of the compressor into the internal space 18 of the housing 9. The labyrinth seal 17 has the heat-insulating jacket 8 mounted thereon.

The turbocompressor operates, as follows.

Exhaust gases from the associated internal combustion engine (not shown in the drawings) are directed through the inlets (not shown) of the gas intake housing 3 (FIG. 1) toward the nozzle ring 10 which directs the flow of the hot gas onto the rotor 4 of the turbine.

The gas flow sets the rotor 4 of the turbine in rotation, whereby the compressor rotor 2 mounted on the same shaft 7 is rotated, too, and charges air through the diffuser 5 and the scroll 6 into the cylinders of the engine.

Spent gases leaving the turbine flow into the internal space 18 of the cooled housing 9 for escape of spent gases from the turbine and leave the turbocompressor through the outlet 19.

With the turbocompressor having the herein disclosed structure, its cooled housing 9 for escape of spent gases from the turbine can be made of formed elements and members made of steel rolled shapes of thickness not in excess of 3 to 5 mm, which reduces the weight of this housing 1.8 times in comparison with a housing for a similar use, made by casting, e.g. of iron, enhances the repairability of the housing and of the turbocompressor, as a whole, and reduces the amount of metal in the turbocompressor.

What we claim is:

1. In a turbocompressor, comprising:

a shaft, a compressor housing, a compressor rotor accommodated in said compressor housing and mounted on said shaft; a turbine rotor mounted on the same shaft with said compressor rotor; a gas intake housing for supplying hot gas to said turbine rotor, accommodated in said gas intake housing; a housing cooled by a fluid, for escape of spent gases from said turbine rotor;

an improvement residing in that said cooled housing includes a load-carrying framework defined by two spaced flanges and by longitudinal rigid shaped thin-wall steel elements interconnecting said flanges and spaced from one another, the spaces between said shaped elements being filled with thin steel panels defining jointly with the said shaped elements the external wall of the housing, the internal wall of the housing being made in the form of a plain thin-wall trough-shaped steel sheet secured to said flanges and arranged so that a space is defined intermediate said internal wall and said external wall for circulation of a cooling fluid therethrough.

2. A turbocompressor as set forth in claim 1, including at least two interconnecting elements adapted to interconnect said plain thin-wall trough-shaped sheet defining the internal wall of the cooled housing with said thin steel panels defining said external wall of said housing, in two symmetrical areas with respect to a vertical plane.

3. A turbocompressor as set forth in claim 1, wherein said rigid longitudinal shaped thin-wall steel elements are substantially trough-shaped and have concave sides facing said internal wall of said housing.

4. A turbocompressor as set forth in claim 2, wherein said rigid longitudinal shaped thin-wall steel elements are substantially trough-shaped and have concave sides facing said internal wall of said housing.

* * * * *